United States Patent [19]

Morita

[11] Patent Number: 4,571,973

[45] Date of Patent: Feb. 25, 1986

[54] METHOD AND APPARATUS FOR FORMING A PIG TAIL END ON A COIL SPRING

[75] Inventor: Motoo Morita, Aichi, Japan

[73] Assignee: Morita Iron Works Company, Ltd., Aichi, Japan

[21] Appl. No.: 603,189

[22] Filed: Apr. 23, 1984

[30] Foreign Application Priority Data

Apr. 26, 1983 [JP] Japan ..... 58-74592

[51] Int. Cl.[4] ..... B21F 3/10; B21F 35/02

[52] U.S. Cl. ..... 72/137; 72/139; 72/371

[58] Field of Search ..... 29/173; 72/137, 138, 72/139, 142, 135, 140, 371; 140/89, 103

[56] References Cited

U.S. PATENT DOCUMENTS 4,424,695 1/1984 Kirchhoff et al. ..... 72/128

*Primary Examiner*—E. Michael Combs

*Attorney, Agent, or Firm*—Schwartz & Weinrieb

[57] ABSTRACT

Disclosed herein is a method and apparatus for producing a barrel-shaped coil spring, by forming a coil spring having a first pig tail at one end, with a second pig tail at the other end. The method comprises providing a winding jig having a spiral stepped portion suited for forming a desired second pit tail; inserting the winding jig into the other end of the coil spring; and providing a rotary spindle for modifying the other end of the coil spring axially and radially relative to the winding jig, thereby winding the other end of the coil spring around the winding jig to form the desired second pig tail. Apparatus for performing the method is disclosed which comprises a winding jig and a cooperative rotary spindle to provide the second pig tail on the coil spring.

22 Claims, 14 Drawing Figures

METHOD AND APPARATUS FOR FORMING A PIG TAIL END ON A COIL SPRING

FIELD OF THE INVENTION

This invention relates to a method of forming a pig tail end on a coil spring and an apparatus therefor, and more particularly to a method and apparatus for producing a barrel-shaped coil spring by forming a coil spring having a first pig tail at one end thereof, and to provide a second pig tail at the other end thereof.

BACKGROUND OF THE INVENTION

FIG. 1 illustrates a typical coil spring 10 which is widely used as a chassis spring in independent suspension systems of vehicles, and as may be seen, the coil spring 10 has a maximum diameter d at the medial portion of the barrel and converges axially from the medial portion to the ends thereof so as to have a generally barrel-shaped configuration. In such a barrel-shaped coil spring, the wound portion of the coil wire which converges toward each end to form a frusto conical configuration is called a pig tail. Various methods have been proposed heretofore to manufacture barrel-shaped coil springs having respective pig tails at the opposite ends. However, all of them disadvantageously require increased forming steps or fails to wind the coil spring with desired pitches, which can result in variations in the products. Specifically, it is difficult to shape the whole coil spring in but a single step while using a mandrel, because the opposite ends of the barrel-shaped coil spring are formed so as to have a frusto conical configuration. Another known method is to manufacture barrel-shaped coil springs without using a mandrel, wherein the coil wire is held by a pair of opposed supporting rolls and associated pressing rolls, and the position of the supporting rolls is variably controlled relative to the pressing rolls. In such a method, however, it will be noted that desired pitches can not be obtained, which disadvantageously tends to cause variations in the products.

Thus, the prior art method has been unsuccessful in forming a barrel-shaped coil spring in but a single step, and employed two steps. Here, an intermediate coil spring with a pig tail at one end is first manufactured by known means including a mandrel, as shown in FIG. 2, and thereafter, in a second step, the intermediate coil spring is formed to provide a second pig tail at its other end. FIG. 3 illustrates such a method of forming a pig tail at the other end of the intermediate coil spring, and as may be seen, the initial position X for forming a pig tail on the coil spring 10 is held by a first clamping means 12, and the free end E of the coil spring 10 is clamped by a second clamping means 14, which is rotated toward the coil center C along a locus depicted by the arrow. In this prior art method, however, the number of turns of the pig tail to be formed has been limited to one, namely, a maximum of 360 degrees in terms of rotational angle. Thus the prior art has failed to meet the specific production requirements for various pitches and spring constant of barrel-shaped coil springs. Further, since pig tails have been formed in a free condition without using a jig such as a mandrel, the finish accuracy of products has been inconsistent.

OBJECTS OF THE INVENTION

It is, accordingly, an object of the present invention to avoid the noted disadvantages associated with the prior art method of forming a coil spring having a pig tail at one end and to provide a second pig tail at the other end.

It is another object of the present invention to provide uniform quality coil springs by improving the forming accuracy of pig tails through the use of a mandrel having a spiral stepped portion suited for forming a desired pig tail.

SUMMARY OF THE INVENTION

In accordance with the present invention there is provided, as schematically shown in FIG. 4, a method of forming a coil spring 10 having a first pig tail at one end, by provide a second pig tail on the other end, comprising the steps of providing a winding jig 16 having a spiral stepped portion suited for forming a desired pig tail, inserting the winding jig 16 into the space between coils of the coil spring 10, providing a first clamping means 12, holding the coil spring 10 at the initial position X for forming a pig tail by the first clamping means 12, providing a second clamping means 14, clamping the coil spring 10 at the free end E by the second clamping means 14, rotating the second clamping means 14 in the direction in which the coil spring 10 is wound, thereby winding the coil spring end along the spiral stepped portion on the winding jig 16, and causing the second clamping means 14 to move radially inwardly to the center C of the coil spring 10.

Also in accordance with the present invention there is provided, as diagrammatically shown in FIG. 5, an apparatus for performing the method which comprises a cradle 18 adapted to accommodate a coil spring 10 thereon, a pushing plate 20 for pressing the coil spring 10 forwardly in the axial direction, a winding jig 16 disposed generally above the coil spring 10 on the cradle 18 and adapted to be inserted into and removed from the space between coils of the coil spring 10, the winding jig 16 having a spiral stepped portion suited for forming a desired pig tail, a first clamping means 12 for holding the coil spring 10 at the initial position X for forming a pig tail, a rotary spindle 22 disposed generally forward of the cradle 18 in spaced, aligned relation to the cradle 18, a second clamping means 14 mounted on one end of the rotary spindle 22 and adapted for clamping the free end of the coil spring 10, and a sliding means 24 for sliding the rotary spindle 22 in a direction perpendicular to the central axis of the rotary spindle 22.

BRIEF DESCRIPTION OF THE DRAWINGS

The invention will now be described by way of example and with reference to the accompanying drawings, in which.

DETAILED DESCRIPTION OF THE INVENTION

Figure 1:
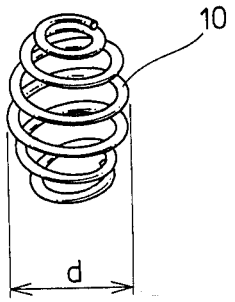
FIG. 1 is a schematic view of a barrel-shaped coil spring.
Figure 2:
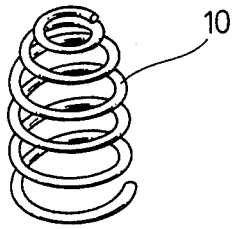
FIG. 2 is a schematic view of a coil spring having a pig tail formed at its one end.
Figure 3:
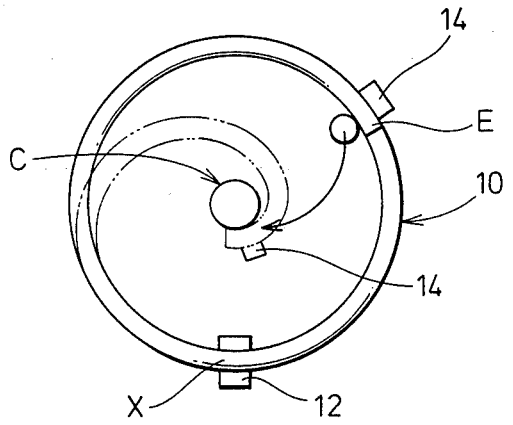
FIG. 3 PRIOR ART
FIG. 3 is a schematic diagram illustrating the prior art method of forming a pig tail.
Figure 4:
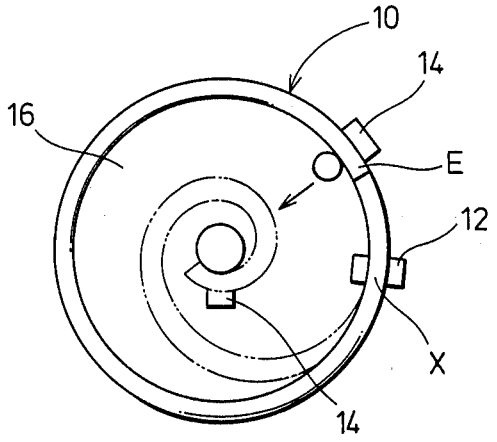
FIG. 4 is a schematic diagram illustrating a method of forming a pig tail in accordance with the present invention.
Figure 5:
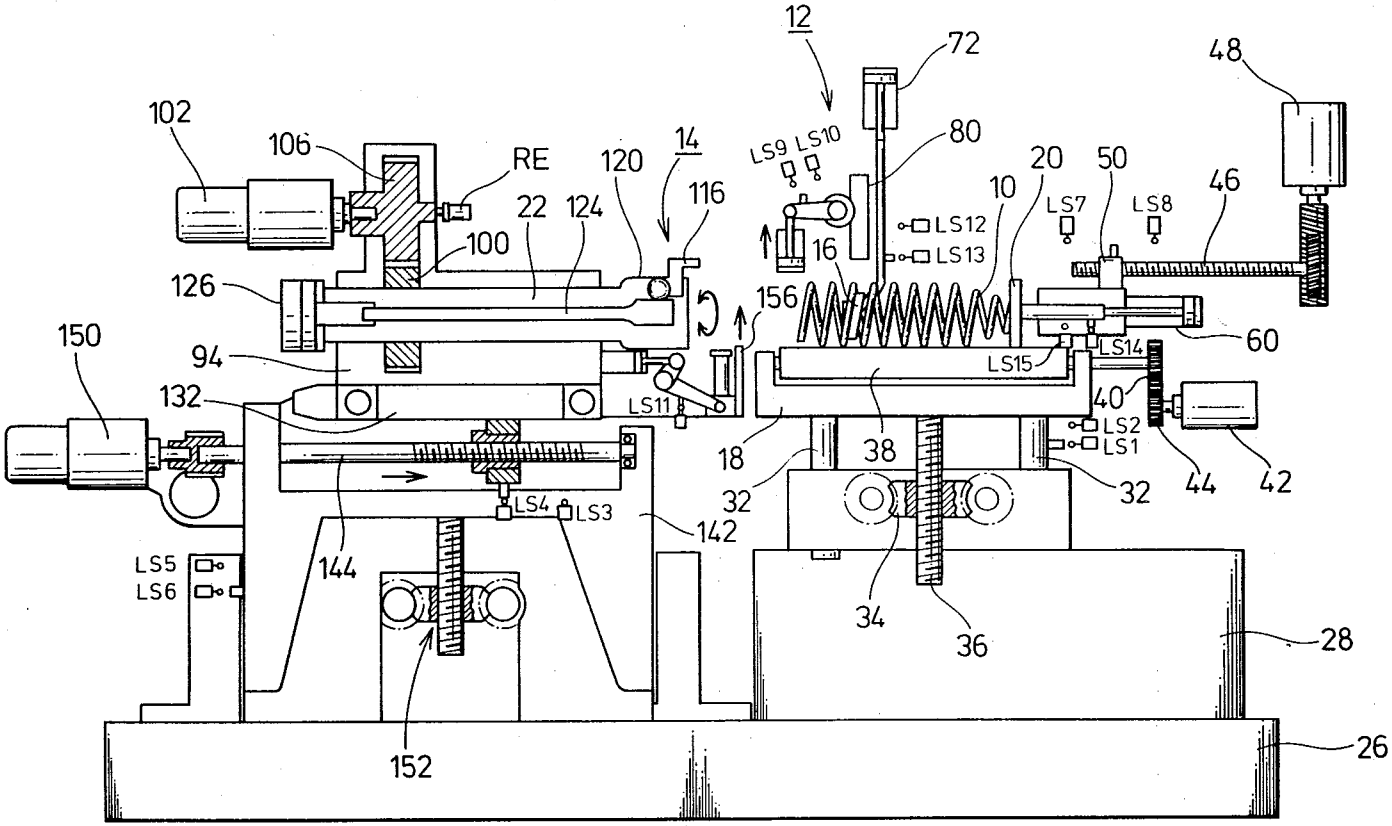
FIG. 5 is a diagrammatical overview of the whole construction of a pig tail forming apparatus according to the present invention.

Reference will now be made to FIG. 5, illustrating a pig tail forming apparatus which is the subject of the present invention, although reference may also be made to FIGS. 6 to 9 to assist in understanding of the description. The same reference numerals have been used to identify the same or similar elements of FIGS. 3 and 4.

The pig tail forming apparatus of the present invention basically comprises a cradle 18 and a rotary spindle 22 disposed on a common base 26 in spaced, aligned relation to each other. Positioned on the cradle 18 is an intermediate coil spring 10 having a pig tail at one end. The free end E is clamped by a second clamping means 14 mounted on the rotary spindle 22, which imparts to the free end E a rotational force in a direction of winding and a motion in the radially inward direction of the coil spring 10, to thereby form a pig tail on the coil spring 10.

CRADLE 18

Figure 6:
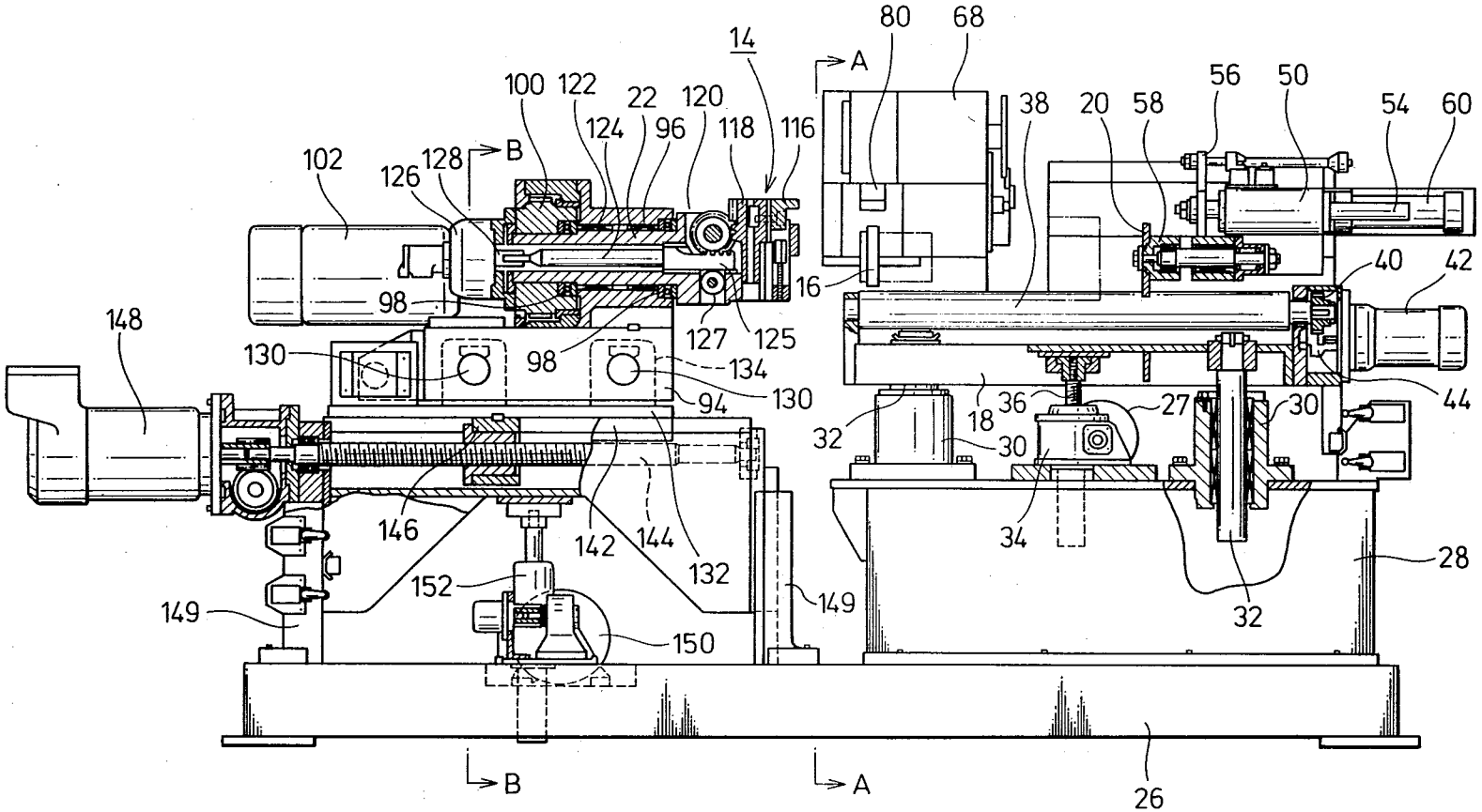
FIG. 6 is a vertical sectional view, with portions broken away, illustrating in detail the construction of a preferred embodiment of the present invention.
Figure 7:
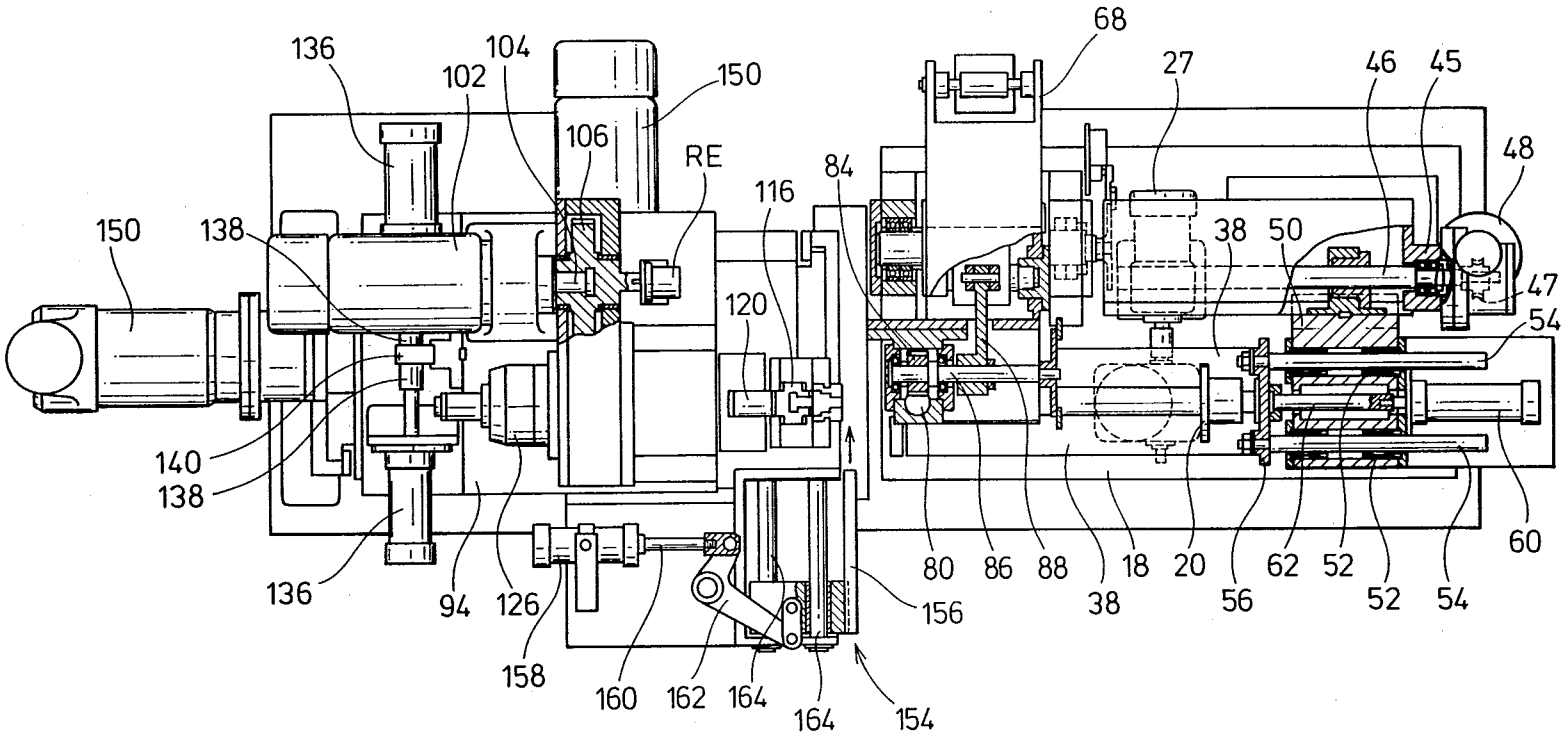
FIG. 7 is a plan view, with portions broken away, of the apparatus illustrated in FIG. 6.
Figure 8:
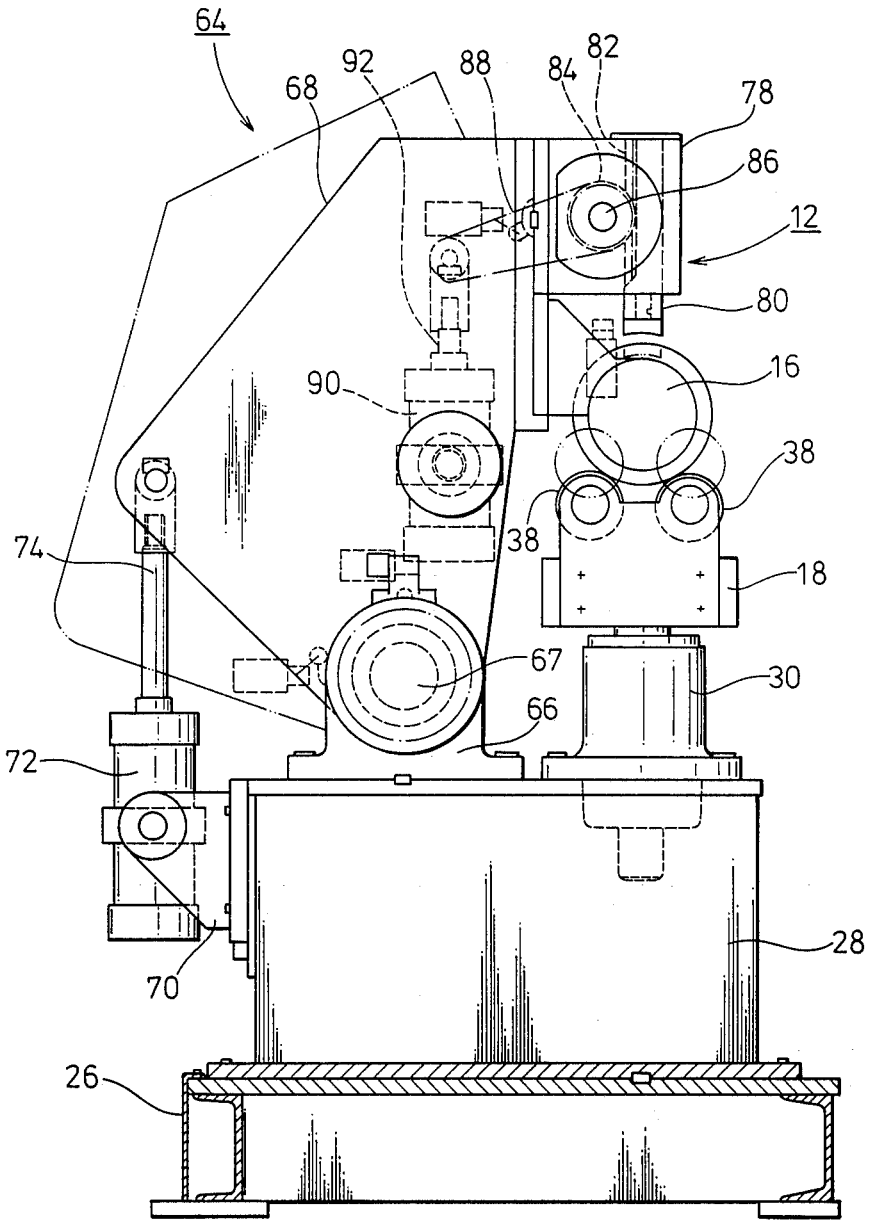
FIG. 8 is a view taken in the direction of the arrows A—A in FIG. 6.
Figure 9:
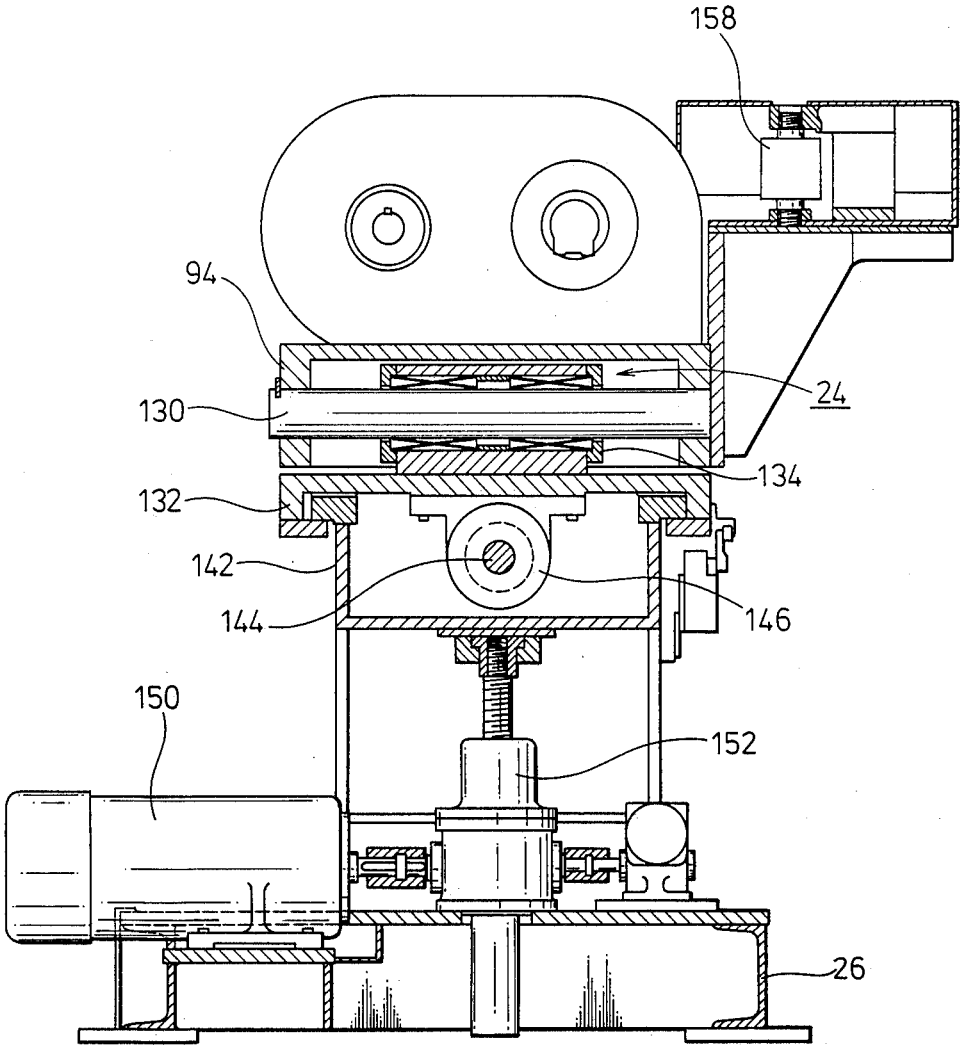
FIG. 9 is a sectional view taken substantially along line B—B in FIG. 6.

The cradle 18 is horizontally disposed above and vertically slidable with respect to a box frame 28 mounted on the base 26. As may be seen in FIG. 6, the base 26 has a box frame 28 fixedly connected thereto. The box frame 28 has a pair of bearings 30 disposed vertically on the top thereof. Each of the bearings 30 includes an elevating member 32 vertically slidably inserted therein and fixedly connected to the cradle 18. The box frame 28 further includes a screw jack 34 of the worm reduction gear type which is mounted thereon and driven by a motor 27. The screw jack 34 has a screw shaft 36 projecting vertically upwardly therefrom and rotatably connected to the bottom of the cradle 18 through rotation supporting means, so that the cradle 18 may be vertically moved. As is shown in FIGS. 6, 7 and 8, the cradle 18 is provided with a pair of rollers 38 horizontally rotatably carried thereon in spaced, parallel relation with one another. As may be seen best from FIG. 5, each of the rollers 38 has a gear 40 fixedly connected at one end thereof and engageable with a pinion 44 which is fixedly connected to the rotary shaft of a motor 42, so that the rollers 38 may be rotated in the same direction. The coil spring 10 having a pig tail end is placed on and rotated with the rotating rollers 38 so as to be brought into a proper posture and position for the subsequent operation.

PUSHING PLATE 20

Mounted generally above the cradle 18 is a pedestal 45 which has a pushing plate 20 for pushing the coil spring 10 on the rollers 38 axially forwardly (leftwardly as viewed in FIGS. 5, 6 and 7). As is best shown in FIG. 7, the pedestal 45 has a ball screw shaft 46 horizontally rotatably carried therein and juxtaposed in parallel relation to the rollers 38. The ball screw shaft 46 is operatively connected at one end to a reversible motor 48 through a worm gear means 47 for rotation therewith. The ball screw shaft 46 is further threadably engaged with a sliding block 50 disposed above the rollers 38 in an overhanging manner. Thus it will be noted that the sliding block 50 may slide transversely above the rollers 38 through the forward and reverse rotations of the screw shaft 46. It should also be noted that this sliding mechanism is employed to provide for different lengths of coil springs to be shaped. To push the coil spring 10 in its axial direction, a pushing plate 20 is provided which will be hereinafter explained.

With continuing reference to FIG. 7, the sliding block 50 is provided with a pair of parallel bearings 52, each having a guide rod 54 horizontally slidably received therein. Fixedly connected to both the guide rods 54 at their forward end (left-hand end as viewed in FIG. 7) is a bracket 56 to which is rotatably connected a pushing plate 20 through a bearing 58. The sliding block 50 also has a double-acting air cylinder 60 which is horizontally and fixedly connected at the rear end (right-hand end as viewed in FIG. 7). The cylinder 60 includes a piston rod 62 fixedly connected at its extremity to the bracket 56. Therefore, when the cylinder 60 is actuated to thereby extend the piston rod 62 from the cylinder tube, the pushing plate 20 carried on the bracket 56 is pushed forward (leftward in FIG. 7) above the rollers 38 in a non-contacting manner. Conversely, when the cylinder rod 62 is retracted into the cylinder tube, the pushing plate 20 is released from its operative position.

Winding Jig 16

Figure 10:
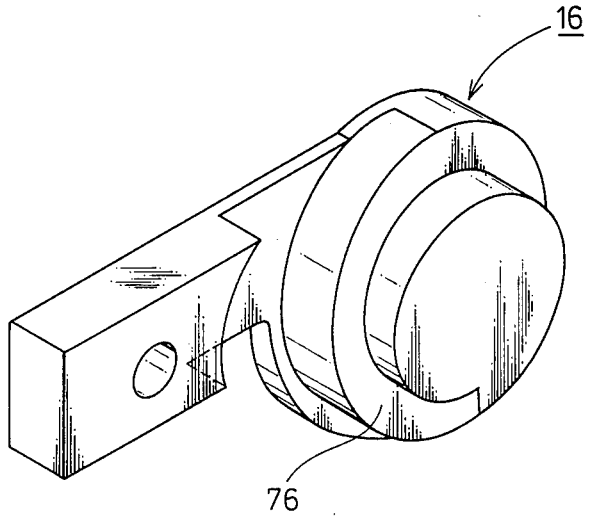
FIG. 10 is a perspective view of a winding jig for use in the apparatus of the present invention.

Referring now to FIG. 8, the apparatus of the present invention is further provided with a winding jig 16 to be inserted into and removed from the space between coils of the coil spring 10 placed on the cradle 18, and a tiltable supporting means 64 for moving the winding jig 16. As shown in FIG. 8, the box frame 28 includes secured thereto a clevis 66 which in turn has a specially shaped arm 68 pivotally connected thereto at its lower end through a shaft 67. The arm 68 has at its upper portion a head 78 adapted to be brought above the rollers 38 in its vertically stand-up position. Another clevis 70 is fixedly mounted on the vertical side wall of the box frame 28, which has an air cylinder 72 pivotably connected thereto. The cylinder 72 has a piston rod 74 pivotally connected to one end of the arm 68 through a suitable connecting means so that the arm 68 may pivot about the shaft 67 with the actuation of the piston rod 74. The arm 68 also has removably mounted thereto a mandrel or winding jig 16 which is formed into a configuration as shown in FIG. 10. When the arm 68 is brought to its substantially vertical position as illustrated by solid lines in FIG. 8, the winding jig 16 is so positioned as to be inserted, in a non-contacting manner, into the space between coils of the coil spring 10 placed on the rollers 38. After being inserted in the space between coils of the coil spring 10, the winding jig 16 serves as a guide wherein a pig tail is wound along a spiral stepped portion 76 formed on the winding jig 16. It should be noted that the spiral stepped portion 76 has a specific pitch and diameter to suit a desired pig tail. Thus, a number of winding jigs 16 having a different pitch and diameter may be supplied as attachments to thereby enable users to select a desired pitch or diameter of the pig tail to be formed by removing and replacing the winding jig 16 from the arm 68. The coil spring 10, with the winding jig 16 inserted in its space between coils, is pressed to move slightly rightward by a rotary spindle 22 which will be hereinafter explained. The winding jig 16 also serves as a tightening seat in a first clamping means 12 which will also be further described below, and thus the coil spring 10 requires to be slightly moved rightward by the rotary spindle 22 so that the winding jig 16 may be positioned below the initial position X for forming a pig tail on the coil spring 10.

FIRST CLAMPING MEANS 12

With continuing reference to FIG. 8, the arm 68 is provided at the upper side portion thereof with a first clamping means 12 for holding the initial position X for forming a pig tail on the coil spring 10. The first clamping means 12 is composed of a clamping member 80 movably housed in the vertical direction in the head 78 which is disposed within the right region (as viewed in FIG. 8) of the upper portion of the arm 68; and the jig 16 is disposed opposite to the lower end of the clamping member 80 and serving as a seat for the coil spring 10. The clamping member 80 extends vertically below the head 78 and has formed thereon a rack 82 which engaged with a pinion 84 carried in the head 78 for vertical upward and downward movement. As may be seen best from FIG. 7, the pinion 84 has a rotary shaft 86 which is in turn journaled in the head 78 and at the same time fixedly connected to one end of a lever 88. The other end of the lever 88 is pivotally connected to a piston rod 92 of a double-acting air cylinder 90. With this arrangement, when the piston rod 92 is actuated to pivot the lever 88 about the rotary shaft 86 in a clockwise direction, the clamping member 80 is lowered through engagement of the pinion 84 with the rack 82 so as to positively hold the coil spring 10 between the lower end of the clamping member 80 and the seat of the winding jig 16. (It should be noted that this clamping position is the initial position X for forming a pig tail of the coil spring 10, which will be hereinafter described.) Conversely, when the piston rod 92 of the cylinder 90 is retracted into the piston tube, the clamping member 80 is raised to thereby release the coil spring 10 from its clamped position between the clamping member 80 and the winding jig 16.

ROTARY SPINDLE 22

The apparatus of the present invention includes a rotary spindle 22 disposed generally above the base 26 and in alignment with the cradle 18. As generally seen in FIG. 6, the apparatus includes a horizontal table 94 mounted on the base 26 through a bed 132 and an elevating pedestal 142 which will be described hereinafter in greater detail. The horizontal table 94 has a cylindrical spindle housing 96 horizontally secured thereto, which in turn has a hollow cylindrical rotary spindle 22 rotatably supported therein through a pair of bearings 98. The rotary spindle 22 has a large-diameter gear 100 secured at the left-hand (as viewed in FIG. 6) end thereof. The gear 100 engages a gear 106, as seen in FIG. 5 secured to a rotary shaft 104, as seen in FIG. 7 of a reduction-geared motor 102. Therefore, when the motor 102 is driven, the rotary spindle 22 is powerfully driven for rotation through the gear train thus arranged. It will be noted that the rotary spindle 22 serves to impart a rotational force in a direction the coil spring 10 is wound to thereby form a pig tail on the other end of the coil spring 10.

SECOND CLAMPING MEANS 14

Figure 11:
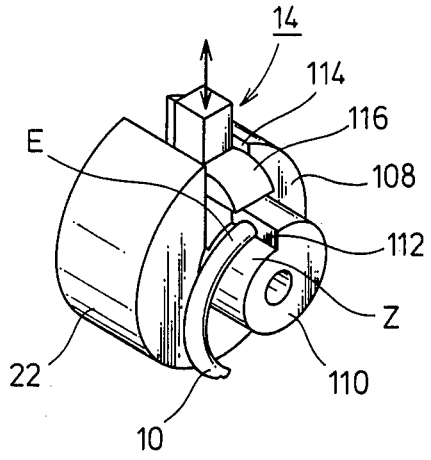
FIG. 11 is a perspective end view of a rotary spindle for use in the apparatus of the present invention.
Figure 12:
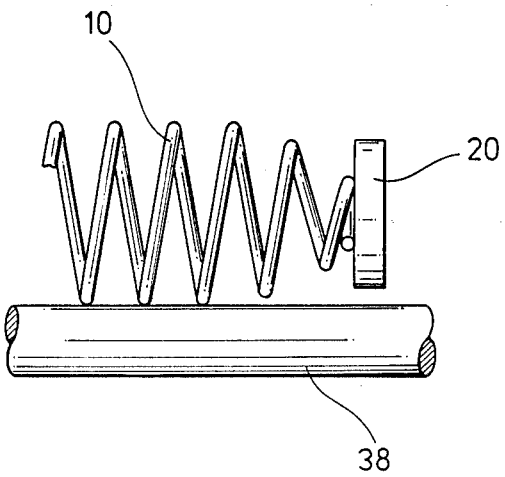
FIG. 12 is a schematic view showing a pushing plate positioned against a coil spring on the rollers included in the apparatus of FIG. 5.
Figure 14:
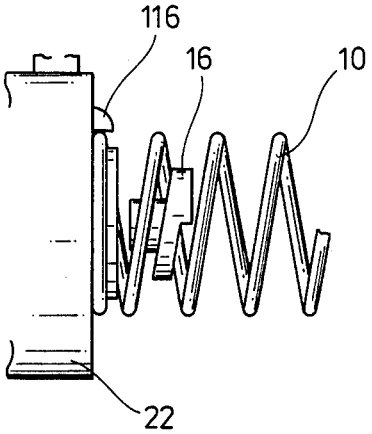
FIG. 14 is a schematic view illustrating the winding jig inserted into the space between coils of a coil spring.

The rotary spindle 22 has at one end thereof a second clamping means 14 for captively clamping the free end E of the coil spring 10. As generally shown in FIG. 11, the rotary spindle 22 has an end face 108 directed toward the cradle 18, which in turn has a small-diameter cylindrical member 110 extending axially therefrom. The end of cylindrical member 110 is eccentrically cut away to provide a cutout end 112 which serves as a stopper to receive the free end E of the coil spring 10 for directional control, as described below in greater detail. The peripheral region (indicated by the letter Z in FIG. 11) adjacent the cutout end 112 of the cylindrical member 110 serves as a seat for the second clamping means 14. The spindle 22 also has a radial groove 114 in the end face 108. Radially slideable in the groove 114 is a jaw 116 which is an essential part of the second clamping means 14. As may be seen best from FIG. 6, the jaw 116 is provided with, at its vertical back portion, a rack 118 which a pinion 120 engages. The pinion 120 also engages a rack 125 at the right-hand end (as viewed in FIG. 6) of a rod 124 inserted in a hollow portion 122 of the rotary spindle 22. The rack 125 is carried on a free roller 127, and the rod 124 is connected at its left-hand end to a piston rod 128 of a rotary hydraulic cylinder 126. Therefore, when the rod 128 of the hydraulic cylinder 126 is moved horizontally leftward, the jaw 116 moves radially inwardly through the meshing engagement of the series of rack and pinion combination, so as to clamp the free end E of the coil spring 10 between the lowermost end of the jaw 116 and the seat Z of the cylindrical member 110. Conversely, when the rod 128 of the hydraulic cylinder 126 is moved horizontally rightward, the jaw 116 moves radially outwardly to release the coil spring 10 from its clamped position on the seat Z of the cylindrical member 110.

SLIDING MEANS 24

The rotary spindle 22 is arranged to be movable in a direction perpendicular to the central axis thereof through a sliding means 24. As may be seen in FIGS. 6 and 9, the table 94 with the rotary spindle 22 mounted thereon further includes a pair of parallel slide bars 130 extending horizontally in a direction perpendicular to the central axis of the rotary spindle 22. The slide bars 130 are slidably received by bearings 134 mounted on a bed 132 which will be hereinafter described. Thus, it will be appreciated that the table 94 with the rotary spindle 22 is slidable on the bed 132 in a direction perpendicular to the central axis of the spindle 22 through the slide bars 130. To this end, a pair of horizontal air cylinders 136 are provided in opposed relation to one another, as shown in FIG. 7, each having a piston rod 138 operatively connected thereto. The piston rods 138 tightly hold therebetween a horizontal projection 140 which is fixedly connected to the table 94 so as to retain the table 94 in place. As should be apparent, the cylinders 136 may be deactuated to thereby allow the table 94 to slide freely on the bed 132. With this arrangement, namely, as the sliding means 24 permits the rotary spindle 22 to slide in a direction perpendicular to the central axis of the spindle 22, the second clamping means 14 may be moved radially inwardly, when a pig tail is being formed on the other end of the coil spring 10, as described below in greater detail.

OTHER MAJOR MEANS (1) Sliding of Bed 132

The bed 132 on which is provided the sliding means 24 is slideably mounted in the horizontal direction on an elevating pedestal 142, as shown in FIG. 6. The elevating pedestal 142 includes a horizontally disposed ball screw shaft 144 which is threadably engaged with an internally threaded member 146 secured to the bottom of the bed 132. Thus, when the ball screw shaft 144 is driven for forward and reverse rotation by a reduction-geared motor 148, the bed 132 is longitudinally moved along the central axis of the rotary spindle 22 under the influence of feeding action of the ball screw shaft 144 relative to the internally threaded member 146.

(2) Elevating of Pedestal 142

The elevating pedestal 142 is movably supported in the vertical direction by a pair of struts 149 which are uprightly disposed on the base 26, and is driven for vertical movement by a worm type screw jack 152 mechanically connected to a motor 150. In conclusion, the elevating pedestal 142 is vertically movable along the Z-axis, the bed 132 is slidable along the X-axis, and the table 94 is along the Y-axis. Thus it will be noted that the rotary spindle 22 on the table 94 is movable in the three-dimensional directions along the X-, Y- and Z-axes.

(3) Flattening Means of Coil Spring End

As generally shown in FIG. 7, the apparatus of the present invention includes an extra flattening means 154 which is adapted to flatten the last turn of the coil spring 10 on which a pig tail has been formed. The last turn of the formed pig tail end is modified by a pressing member 156 to a plane surface perpendicular to the central axis of the coil spring 10 for better stability and ease of installation as in a coil spring automatic assembly apparatus. To this end, the pressing member 156 is connected to a piston rod 160 of an air cylinder 158 through a link lever 162 so that the pressing member 156 is slidable through guide rods 164 in the direction of the arrow in FIG. 7. The bed 132 is moved rightward to thereby press the pressing member 156 against the other end of the coil spring 10 to modify the end to a plane surface.

LIMIT SWITCHES FOR SENSING THE OPERATIVE POSITION OF MAJOR COMPONENTS

The apparatus of the present invention includes various limit switches for sensing the operative position of major components, as schematically shown in FIG. 5. The limit switches sense the following positions:

LS1: lower limit of vertical movement of cradle 18

LS2: upper limit of vertical movement of cradle 18

LS3: limit of forward (rightward) movement of bed 132

LS4: limit of rearward (leftward) movement of bed 132

LS5: upper limit of vertical movement of pedestal 142

LS6: lower limit of vertical movement of pedestal 142

LS7 limit of forward (leftward) movement of sliding block 50

LS8 limit of rearward (leftward) movement of sliding block 50

LS9: clamping of pressing member 80

LS10: releasing of pressing member 80

LS11: return of pressing member 156

LS12: removal of jig 16

LS13 insertion of jig 16

LS14 limit of rearward(rightward) movement of pushing plate 20

LS15: limit of forward(leftward) movement of pushing plate 20

OPERATION OF THE PRESENT METHOD AND APPARATUS

The operation of the pig tail forming apparatus having the foregoing construction will be now explained with reference to the method of forming a pig tail according to the present invention. First, a coil spring 10 having a pig tail at one end is placed on the rollers 38 of the cradle 18. It should be noted that the coil spring 10 is heated previously, for example, to approximately 850°-900° C. Therefore, the pig tail forming operation is accomplished as a part of hot working process. The motor 48 is driven, depending on the length of coil spring 10 to be placed on the rollers 38, to thereby longitudinally adjust the sliding block 50 so that the pushing plate 20 may be positioned close to the pig tail end of the coil spring 10. Further, the cradle 18 is raised under the influence of the elevating action of the screw jack 34 for the adjustment of the height depending on the outside diameter of the coil spring 10.

Figure 13:
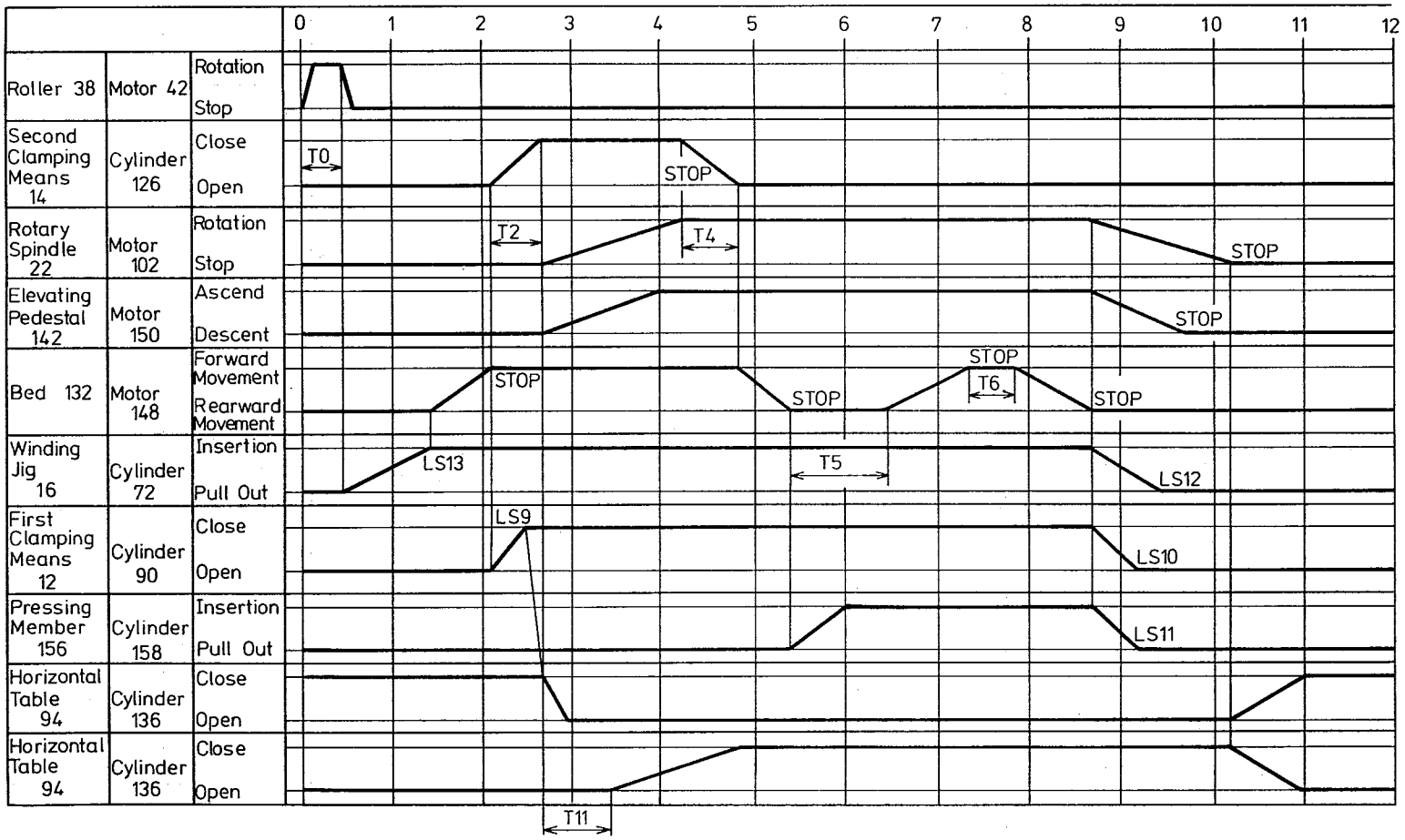
FIG. 13 is a sequence diagram of the apparatus of the present invention.

The cylinder 60 is then actuated to advance the pusher 20 to press the coil spring 10 axially leftward, and at the same time the motor 42 is rotated, as shown by sequence diagram in FIG. 13, to drive the rollers 38 for rotation in the same direction. As a result, the coil spring 10 on the rollers 38 is rotated until the free end E (the other end of the coil spring 10 on which a pig tail is not formed) contacts the cutout end 112, as shown in FIG. 11, so that the coil spring 10 may be stopped to be positionally restricted.

Actuation of the air cylinder 72 (FIG. 8) pivots the arm 68 in the clockwise direction to thereby cause the winding jig 16 to be inserted into the space between coils of the coil spring 10. The motor 148 shown in FIG. 6 is then momentarily rotated to move the bed 132 slightly rightward, causing the coil spring 10 contacting the end face 108 of the rotary spindle 22 to be slightly compressed toward the winding jig 16. At this time, the winding jig 16 is positioned immediately below the initial position X shown in FIG. 4. Then, the air cylinder 90 is actuated to pivot the lever 88 in the clockwise direction, thereby lowering the clamping member 80 of the first clamping means 12 to hold the initial position X of the coil spring 10 against the seat of the winding jig 16.

Further, the hydraulic cylinder 126 of the second clamping means 14 is actuated to lower the jaw 116 through the rack and pinion means so as to clamp the free end E of the coil spring 10 against the seat Z of the cylindrical projection 110 (FIG. 11).

Then, the motor 102 is driven to thereby rotate the rotary spindle 22 in the direction in which the coil spring 10 is wound. Since the coil spring end E is clamped by the second clamping means 14 at the end portion of the rotary spindle 22, the coil spring end will be formed into a pig tail configuration along the stepped portion 76 of a desired pitch provided on the winding jig 16.

As soon as (or preferably slightly before) the rotary spindle 22 is rotated, the two opposed air cylinders 136 shown in FIG. 7 are deactuated into their unrestricted position to thereby release the table 94 from its positionally restricted condition. Therefore, the table 94 is allowed to move freely along the slide bars 130 in a direction perpendicular to the central axis of the rotary spindle 22. Further, the motor 150 for controlling the elevating pedestal 142 is driven substantially in accordance with the forming condition of the desired second pig tail to be formed on the coil spring, thereby causing the screw jack 152 to be raised slowly. The elevating pedestal 142 is then vertically moved in a direction perpendicular to the table 94.

As the other end of the coil spring 10 is wound up along the stepped portion 76 of the winding jig 16 through the rotation of the rotary spindle 22, the second clamping means 14 is caused, without being influenced by undue forces, to move radially inwardly, that is toward the center of the coil spring 10, through the composition of free sliding movement of a table 94 and controlled vertical movement of the elevating pedestal 142. As the result, the other end of the coil spring 10 is wound up from a cylindrical configuration into a spiral to form a desired second pig tail as shown in FIG. 4.

When the winding of the other end is completed by the rotation of the rotary spindle 22, the motor 102 will be stopped in response to a signal from a rotary encoder RE mounted to the pinion gear 106 of the motor 102. At the same time the hydraulic cylinder 126 is deactuated to raise the jaw 116 of the second clamping means 14 so as to release the coil spring end from its clamped position. Then, the motor 148 (FIG. 6) is reversed, and through the reverse rotation of the ball screw shaft 144, the bed 132 is retracted slightly leftward to thereby provide a desired space between the end face 108 of the rotary spindle 22 and the coil end on which a pig tail has been formed. Thereafter, the air cylinder 158 (FIG. 7) is actated to move the pressing member 156 into the space through the pivotal movement of the link lever 162, as depicted by the arrow in FIG. 7.

The flattening operation may then be started for the coil spring 10. To this end, the motor 148 is driven again in the forward direction, with the other end of the coil spring 10 held by the first clamping means 12, to thereby move the bed 132 axially forwardly. Upon forward movement of the bed 132, the pressing member 156 contacts and presses the last turn at the other end of the coil spring 10 to form a plane seat on the last turn. The bed 132 is then returned by the reverse drive of the motor 148 and the pressing member 156 is also returned through the actuation of air cylinder 158 to its original position shown in FIG. 7.

Finally, the air cylinder 72 is deactuated to thereby remove the winding jig 16 from the space between coils of the coil spring 10, and the jaw 80 of the first clamping means 12 is raised to release the coil spring 10 from its clamped position.

It will be appreciated that in the prior art pig tail forming process, the number of turns has been limited to one turn (360 degrees), whereas in the apparatus of the present invention approximately 2.5 turns is possible. Additionally, the number of turns may be arbitrarily selected in the range of 1–2.5 turns depending on the production requirements specified by users. Whenever the number of turns is required to be changed, the pedestal 142 is raised to vary the clamping position of the second clamping means 14 at the coil end.

From what has been said, it will be apparent that present method and apparatus for forming a pig tail on a coil spring offers the possibility of efficient and accurate forming of a coil spring, having a first pig tail at one end, with a second pig tail at the other end. Additionally, the number of turns of a pig tail may be arbitrarily set within a predetermined range to meet users' requirements. Also, forming of accurate pig tails may be accomplished by using a winding jig, thereby eliminating possible variations in products.

Obviously, many modifications and variations of the present invention are possible in light of the above teachings. It is therefore to be understood that within the scope of the appended claims, the present invention may be practiced otherwise than as specifically described herein.

What is claimed is:

1. A method of forming a second pig tail at a second end of a coil spring having a first pig tail at a first end thereof and a cylindrical body portion extending therefrom toward said second end thereof, comprising the steps of:

orienting said coil spring such that its longitudinal axis is disposed horizontally;

providing a support which is angularly pivotable, about an axis disposed parallel to said longitudinal axis of said coil spring, between a first inoperative position and a second operative position;

mounting a winding jig having a spiral stepped portion suited for forming said second pig tail of said coil spring upon said pivotable support;

moving said pivotable support from said first inoperative position to said second operative position so as to dispose said winding jig at a predetermined position within said cylindrical portion of said coil spring;

providing a first clamping means upon said pivotable support for cooperation with said winding jig;

actuating said first clamping means so as to clamp a predetermined portion of said cylindrical portion of said coil spring between said first clamping means and said winding jig and thereby define an initial position from which said second pig tail can be formed;

providing an elevating pedestal for movement within a vertical direction;

providing a bed which is movable upon said elevating pedestal in a horizontal direction parallel to said longitudinal axis of said coil spring;

providing a table which is movable upon said bed in a horizontal direction perpendicular to said directional movement of said bed;

providing a spindle upon said table which is rotatable about an axis disposed parallel to said longitudinal axis of said coil spring;

providing a second clamping means upon said spindle for grasping said second end of said coil spring upon which said second pig tail is to be formed;

actuating said second clamping means so as to clamp said second end of said coil spring; and controlling said elevating pedestal, said bed, and said table, for in turn controlling said spindle and said second clamping means in rotational, axial, and radial directions relative to said longitudinal axis of said coil spring, so as to wind said second end of said coil spring about said winding jig and thereby form a second pig tail upon said coil spring.

2. A method as defined in claim 1 wherein said placing step includes the steps of:

providing a frame means;

holding said coil spring on said frame means horizontally along the central axis of said coil spring;

providing a holding means for axially holding said coil spring on said frame means; and causing said holding means to engage the first pig tail, thereby axially positioning said coil spring.

3. A method as defined in claim 1 wherein during said movement of said pivotable support:

said winding jig is inserted into said coil spring through the space between coils of said coil spring with said spiral stepped portion of said winding jig directed toward said second end of said coil spring.

4. A method as defined in claim 1 wherein during said actuation of said first clamping means, said coil spring is held by said first clamping means at an initial pig tail forming position opposite to said spiral stepped portion of said winding jig.

5. A method as defined in claim 1 wherein said clamping of said second end of said coil spring includes positioning the free extremity of said second end of said coil spring.

6. A method as defined in claim 1 wherein said controlling step includes the steps of:

moving said second clamping means axially to a predetermined position toward said winding jig, thereby compressing said second end of said coil spring; and rotating said second clamp means in the direction in which said second end of said coil spring is wound.

7. A method as defined in claim 6 wherein said controlling step further includes the steps of:

causing said second clamping means to be in unrestricted position in which said second clamping means is free to move in the radial direction of said coil spring; and during rotation of said second clamping means in the direction in which said second end of said coil spring is wound, allowing said second clamping means to freely move toward the center of said coil spring.

8. In a coil spring having a first pig tail at one end and a cylindrical portion extending therefrom toward the other end, said coil spring being heated to a predetermined suitable temperature, a method of forming a second pig tail at the other end with said coil spring hot, comprising the steps of:

placing said coil spring horizontally while directing said other end forward for forming a desired second pig tail;

providing a winding jig having a spiral stepped portion suited for forming the desired second pig tail;

inserting said winding jig into a predetermined position within said cylindrical portion of said coil spring;

providing a first clamping means;

holding said coil spring at an initial position for forming the desired second pig tail by use of said first clamping means;

providing a second clamping means which is rotatable and movable in both the axial and radial directions of said coil spring for forming the desired second pig tail;

clamping said coil spring at said other end by use of said second clamping means;

controlling said second clamping means to provide as a whole a spiral forming movement including rotational, axial and radial movements;

providing a flattening means;

disengaging and retracting said second clamping means from said other end of said coil spring;

inserting said flattening means into the space between said second clamping means and said other end of said coil spring; and pressing and flattening the last turn of the second pig tail formed on said other end of said coil spring by use of said flattening means while said coil spring is retained by said first clamping means, thereby modifying said last turn of said second pig tail to a plane surface perpendicular to the central axis of said coil spring.

9. Apparatus for forming a second pig tail at a second end of a coil spring having a first pig tail at a first end thereof and a cylindrical portion extending therefrom toward said second end thereof, comprising:

a base;

frame means mounted upon said base for holding said coil spring such that its longitudinal axis is disposed horizontally;

holding means mounted upon one end of said frame means for engaging said first pig tail end of said coil spring so as to axially position said coil spring;

means pivotally mounted upon said frame means about an axis disposed parallel to said longitudinal axis of said coil spring;

a winding jig carried upon said pivotable means in a cantilevered fashion for insertion into and removal from a space defined between successive coils of said cylindrical portion of said coil spring, said winding jig having a spiral stepped portion suitable for forming a predetermined second pig tail upon said second end of said coil spring;

first clamping means mounted upon said pivotable means for holding said coil spring at an initial position when forming said predetermined second pig tail;

an elevating pedestal mounted upon said base at an axial position downstream of said second end of said coil spring as one proceeds in the direction from said first end of said coil spring to said second end of said coil spring, said elevating pedestal being vertically movable relative to said longitudinal axis of said coil spring;

a bed mounted horizontally upon said elevating pedestal and movable longitudinally in the axial direction of said coil spring;

a table mounted horizontally upon said bed and movable in the direction perpendicular to the directional movement of said bed so as to be freely slideable transversely relative to said longitudinal axis of said coil spring;

a rotary spindle rotatably mounted upon said table and longitudinally movable in the axial direction of said coil spring so as to be freely movable in a radially inward direction relative to said coil spring due to the combined movements of said elevating pedestal, said bed, and said table; and second clamping means mounted upon one end of said rotary spindle for retaining the free extremity of said second end of said coil spring.

10. An apparatus as defined in claim 9 wherein said frame means further includes a cradle mounted thereon and a pair of horizontally disposed rollers rotatably carried on said cradle in spaced, parallel relation with one another, said rollers being mechanically connected to a motor and rotatable in the same direction.

11. An apparatus as defined in claim 9 wherein said holding means further includes a pushing cylinder having a piston rod and mechanically connected to one end of said frame means; and a horizontally movable pushing plate connected to said piston rod of said pushing cylinder for abutting the first pig tail of said coil spring.

12. An apparatus as defined in claim 9 wherein said spiral stepped portion of said winding jig has an axial length shorter than the space between coils of said coil spring and a progressively reduced diameter to receive at least more than one turn.

13. An apparatus as defined in claim 9 wherein said first clamping means includes a vertically disposed clamping member movably connected to said pivotable means generally above said coil spring, a lower end of said clamping member being positioned in alignment with an upper periphery of said winding jig when inserted in said coil spring.

14. An apparatus as defined in claim 9 wherein said elevating means is slidably supported at opposite ends thereof by a pair of struts mounted on said base, said elevating pedestal being connected at a medial portion thereof to an upper end of a screw jack actuable by a reversible motor mounted on said base.

15. An apparatus as defined in claim 9 wherein said bed is mounted on the top of said elevating pedestal and slidable through a guide means in the axial direction of said coil spring and has an internally-threaded member fixedly connected to the underside thereof, said internally-threaded member being operatively connected at one end to a motor mounted on one end of said elevating pedestal and at the other end to a ball screw shaft horizontally supported in an upper portion of said elevating pedeatal.

16. An apparatus as defined in claim 9 wherein said table has a pair of parallel slide bars horizontally mounted therewith in a direction perpendicular to the direction of longitudinal movement of said bed, said slide bars being received in bearing means mounted centrally on the top of said bed such that said table is allowed to freely move in said direction perpendicular to the longitudinal direction of said bed.

17. An apparatus as defined in claim 9 wherein said rotary spindle is of hollow cylindrical shape and horizontally received in a housing secured on said table, a rear end of said rotary spindle being operatively connected through geared transmission means to a motor mounted on either said housing or said table.

18. An apparatus as defined in claim 9 wherein said second clamping means includes a seat axially projecting from the forward end of said rotary spindle and a clamping jaw slidably received in a radial groove formed in an end of said rotary spindle, said clamping jaw being actuable by a hydraulic cylinder mounted on one end of a housing for said rotary spindle, said seat and said clamping jaw cooperating to clamp the free end of said coil spring therebetween.

19. An apparatus as defined in claim 18 wherein said clamping means further includes a meshing engagement means for actuation of said jaw and said hydraulic cylinder, said meshing engagement means consisting of a first rack received axially within said rotary spindle and connected to a piston rod of said hydraulic cylinder, a pinion carried within said rotary spindle and engageable with said first rack, and a second rack formed on a rear side of said jaw and engageable with said pinion.

20. Apparatus for forming a second pig tail at a second end of a coil spring having a first pig tail at a first end thereof and a cylindrical portion extending therefrom toward said second end thereof, comprising:

a base;

frame means mounted upon said base for holding said coil spring such that its longitudinal axis is disposed horizontally;

holding means mounted upon one end of said frame means for engaging said first pig tail end of said coil spring so as to axially position said coil spring;

means pivotably mounted upon said frame means about an axis disposed parallel to said longitudinal axis of said coil spring;

a winding jig carried upon said pivotable means in a cantilevered fashion for insertion into and removal from a space defined between successive coils of said cylindrical portion of said coil spring, said winding jig having a spiral stepped portion suitable for forming a predetermined second pig tail upon said second end of said coil spring;

first clamping means mounted upon said pivotable means for holding said coil spring at an initial position when forming said predetermined second pig tail;

an elevating pedestal mounted upon said base at an axial position downstream of said second end of said coil spring as one proceeds in the direction from said end of said coil spring to said second end of said coil spring, said elevating pedestal being vertically movable relative to said longitudinal axis of said coil spring;

a bed mounted horizontally upon said elevating pedestal and movable longitudinally in the axial direction of said coil spring;

a table mounted horizontally upon said bed and movable in a direction perpendicular to the directional movement of said bed so as to be freely slideable transversely relative to said longitudinal axis of said coil spring;

a rotary spindle rotatably mounted upon said table and longitudinally movable in the axial direction of said coil spring so as to be freely movable in a radially inward direction relative to said coil spring due to the combined movements of said elevating pedestal, said bed, and said table;

second clamping means mounted upon one end of said rotary spindle for retaining the free extremity of said second end of said coil spring; and flattening means having a pressing member operatively connected to an actuating cylinder mounted upon said bed for actuating said pressing member in timed relationship with the retraction of said rotary spindle and said second clamping means for interposing said pressing member between said second clamping means and said second pig tail formed upon said second end of said coil spring and then moving said pressing member in timed relationship with the movement of said bed in the axial direction of said coil spring so as to thereby press and modify the last turn of said second pig tail to lie in a common plane.

21. A method of forming a second pig tail at a second end of a coil spring having a first pig tail at a first end thereof and a cylindrical body portion extending therefrom toward said second end thereof, comprising the steps of:

orienting said coil spring such that its longitudinal axis is disposed horizontally;

inserting a winding jig, having a predetermined spiral stepped portion for forming a predetermined second pig tail of said coil spring upon said second end of said coil spring, between a space defined between successive coils of said cylindrical body portion of said coil spring;

clamping a predetermined portion of said cylindrical portion of said coil spring so as to define an initial position from which said predetermined second pig tail of said coil spring can be formed;

providing a rotary spindle, having clamping means thereon for grasping said second end of said coil spring upon which said second pig tail is to be formed, for wrapping said second end of said coil spring about said predetermined spiral stepped portion of said winding jig;

mounting said rotary spindle upon support means which is capable of movement within three, mutually orthogonal directions relative to said longitudinal axis of said coil spring; and controlling said rotary spindle, and its clamping means, in the rotary direction while simultaneously controlling said rotary spindle support means in said three, mutually orthogonal directions, so as to achieve said formation of said second pig tail upon said second end of said coil spring.

22. Apparatus for forming a second pig tail upon a second end of a coil spring which is provided with a first pig tail upon a first end thereof, and a cylindrical body portion extending from said first pig tail portion of said spring to said second end thereof, comprising:

means for supporting said coil spring such that its longitudinal axis is disposed horizontally;

means mounting a winding jig, having a predetermined spiral stepped portion for forming a predetermined second pig tail of said coil spring upon said second end of said coil spring, for insertion between successive coils of said cylindrical body portion of said coil spring;

first clamping means for clamping a predetermined portion of said cylindrical portion of said coil spring so as to define an initial position from which said predetermined second pig tail of said coil spring can be formed;

second clamping means for grasping said second end of said coil spring upon which said second pig tail is to be formed;

a rotary spindle, upon which said second clamping means is mounted, for wrapping said second end of said coil spring about said predetermined spiral stepped portion of said winding jig; and means mounting said rotary spindle for translational movement along three mutually orthogonal axes relative to said longitudinal axis of said coil spring.

* * * * *